US010982304B2

(12) United States Patent
Enjo et al.

(10) Patent No.: US 10,982,304 B2
(45) Date of Patent: Apr. 20, 2021

(54) HEAT-RESISTANT ALLOY FOR HEARTH METAL MEMBER

(71) Applicant: KUBOTA CORPORATION, Osaka (JP)

(72) Inventors: Yohei Enjo, Hirakata (JP); Motoyuki Matsubara, Hirakata (JP); Yuki Hayase, Hirakata (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/344,156

(22) PCT Filed: Sep. 4, 2017

(86) PCT No.: PCT/JP2017/031693
§ 371 (c)(1),
(2) Date: Apr. 23, 2019

(87) PCT Pub. No.: WO2018/079073
PCT Pub. Date: May 3, 2018

(65) Prior Publication Data

US 2020/0071797 A1 Mar. 5, 2020

(30) Foreign Application Priority Data

Oct. 28, 2016 (JP) ..... JP2016-211630

(51) Int. Cl.
*C22C 19/05* (2006.01)
*F27B 3/12* (2006.01)

(52) U.S. Cl.
CPC ..... *C22C 19/055* (2013.01); *C22C 19/053* (2013.01); *F27B 3/12* (2013.01); *F27B 2003/125* (2013.01)

(58) Field of Classification Search
CPC ..... C22C 19/055; C22C 19/053; C22F 1/10
See application file for complete search history.

(56) References Cited

U.S. PATENT DOCUMENTS 3,459,539 A * 8/1969 Bassford ..... C22C 19/05 420/54
4,119,456 A * 10/1978 Roach ..... C22C 19/053 420/452
4,400,209 A * 8/1983 Kudo ..... C22C 19/052 420/443
5,126,107 A * 6/1992 Darnfors ..... C22C 30/00 420/443
5,330,705 A 7/1994 Culling
5,543,109 A 8/1996 Senba et al.
5,882,440 A 3/1999 Shinosaki et al.

FOREIGN PATENT DOCUMENTS

| | | | |
|---|---|---|---|
| JP | SHO 53-95822 | | 8/1978 |
| JP | SHO 56-81661 | A | 7/1981 |
| JP | S56 119750 | A | 9/1981 |
| JP | H05 112842 | A | 5/1993 |
| JP | H07 34166 | A | 2/1995 |
| JP | H07 70681 | A | 3/1995 |
| JP | H08 127848 | A | 5/1996 |
| JP | HEI 8-269611 | A | 10/1996 |
| JP | HEI 10-36936 | A | 2/1998 |
| JP | HEI 10-121172 | A | 5/1998 |

OTHER PUBLICATIONS

European Patent Office, "extended European search report", from corresponding European Patent Application No. 17 865 627.8, dated Apr. 22, 2020, 8 pp.
Japanese Patent Office, "International Search Report" (with English language translation), from corresponding International Application No. PCT/JP2017/031693, dated Nov. 28, 2017, 3 pp.

* cited by examiner

*Primary Examiner* — Jessee R Roe
(74) *Attorney, Agent, or Firm* — Eckert Seamans Cherin & Mellott, LLC

(57) ABSTRACT

The present invention provides a Co-free heat-resistant alloy for a hearth metal member that has properties superior to or equal to those of Co-containing heat resistant steel. The heat-resistant alloy for a hearth metal member according to the present invention is a heat-resistant alloy used in a hearth metal member of a steel heating furnace, the heat resistant alloy containing: 0.05% to 0.5% of C; more than 0% and 0.95% or less of Si, where 0.05%≤C+Si≤1.0%; more than 0% and 1.0% or less of Mn; 40% to 50% of Ni; 25% to 35% of Cr; 1.0% to 3.0% of W; and 10% or more of Fe and inevitable impurities as the balance, with all percentages being in mass %. The heat-resistant alloy for a hearth metal member may further contain 0.05% to 0.5% of Ti and/or 0.02% to 1.0% of Zr, with all percentages being in mass %.

17 Claims, No Drawings

HEAT-RESISTANT ALLOY FOR HEARTH METAL MEMBER

TECHNICAL FIELD

The present invention relates to a heat-resistant alloy used in a hearth metal member of a heating furnace for hot rolling, and more specifically to a heat-resistant alloy used in a skid button or a skid liner.

BACKGROUND ART

In a heating furnace for hot rolling such as a walking beam furnace, a slab (steel ingot) is supported by and conveyed by a hearth metal member such as a skid button or a skid liner. In the heating furnace, the slab is passed through a preheating zone at about 1100° C. or less, a heating zone at about 1100° C. to about 1300° C., and heated to a temperature range higher than about 1300° C. in a soaking zone. That is, the hearth metal member is exposed to high temperature atmospheres and thus is required to have excellent oxidation resistance. Also, the hearth metal member supports hot and heavy slabs, and thus is required to be highly resistant to compressive deformation at high temperatures (compressive deformation resistance rate).

Accordingly, for example, an Fe-based alloy is used in the preheating zone, Co-containing heat resistant steel is used in the heating zone, and a Cr-based alloy is used in the soaking zone. As the Co-containing heat resistant steel used in the heating zone, a heat-resistant alloy that contains Co in an amount of 25% to 45%, with all percentages being in mass %, is known (see, for example, Patent Document 1).

CITATION LIST

Patent Document

[Patent Document 1] JP H10-36936A

SUMMARY OF INVENTION

Technical Problem

In recent years, Co has been designated as a metal regulated under the Japanese Industrial Safety and Health Act, and development has been required for Co-free hearth metal members.

It is an object of the present invention to provide a Co-free heat-resistant alloy for a hearth metal member that has properties superior to or equal to those of Co-containing heat resistant steel.

Solution to Problem

A heat-resistant alloy for a hearth metal member according to the present invention is a heat-resistant alloy used in a hearth metal member of a steel heating furnace, the heat-resistant alloy containing: 0.05% to 0.05% of C; more than 0% and 0.95% or less of Si, where $0.05\% \leq C+Si \leq 1.0\%$; more than 0% and 1.0% or less of Mn; 40% to 50% of Ni; 25% to 35% of Cr; 1.0% to 3.0% of W; and 10% or more of Fe and inevitable impurities as the balance, with all percentages being in mass %.

The heat-resistant alloy for a hearth metal member described above may further contain 0.05% to 0.5% of Ti and/or 0.02% to 1.0% of Zr, with all percentages being in mass %.

The heat-resistant alloy for a hearth metal member described above may contain more than 0% and 0.03% or less of P and/or more than 0% and 0.03% or less of S, with all percentages being in mass %.

The heat-resistant alloy for a hearth metal member described above may contain at least one selected from the group consisting of more than 0% and 0.2% or less of N, more than 0% and 0.2% or less of O, and more than 0% and 0.1% or less of H, with all percentages being in mass %.

Also, a hearth metal member according to the present invention is partially or entirely made of the heat-resistant alloy for a hearth metal member described above.

Advantageous Effects of Invention

The heat-resistant alloy for a hearth metal member according to the present invention is free of Co, and thus will not be regulated under the Japanese Industrial Safety and Health Act. Also, in the heat-resistant alloy for a hearth metal member of the present invention, the properties of Co are ensured by Ni, and the amount of C and the amount of Si are reduced to improve the cleanliness of matrix and prevent a reduction in the inciting point. At the same time, by adding Cr, W, and selectively Ti and Zr, in combination with Ni, high-temperature strength in terms of oxidation resistance, compressive deformation resistance rate, and the like can be increased, as a result of which the heat-resistant alloy of the present invention can have properties superior to or equal to those of Co-containing heat resistant steel, and thus is very useful as an alternative to Co-containing heat resistant steel.

<Reason for Limiting Components>

The heat-resistant alloy for a hearth metal member according to the present invention has the following composition. Unless otherwise stated, "%" means mass %.

C: 0.05% to 0.5%

C bonds to Cr, W, or the like to form a carbide, and has the effect of increasing the high-temperature strength. Accordingly, C is added in an amount of 0.05% or more. On the other hand, if the amount of C exceeds 0.5%, the solidus temperature of the heat-resistant alloy decreases, which leads to a reduction in the melting point. Accordingly the upper limit of the amount of C is set to 0.5%, The upper limit of the amount of C is desirably 0.3%, and more desirably 0.2%.

Si: more than 0% and 0.95% or less

Si is an element that increases the oxidation resistance, and has a deoxidation function. Accordingly, Si is added in order to improve the cleanliness of matrix and reduce low melting point compounds. On the other hand, as will be described below, if the total amount of C and Si exceeds 1.0%, the solidus temperature decreases, which leads to a reduction in the melting point. Thus, the upper limit of the amount of Si is set to 0.95%, which is the value obtained by subtracting the lowest amount of C from the upper limit of the total amount of C and Si.

However, C and Si reduce the solidus temperature and decrease the melting point, and thus the total amount of C and Si (C+Si) is set to 0.05% to 1.0%.

Mn: more than 0% and 1.0% or less

Mn is an element that increases high-temperature strength, and has a deoxidation/desulfurization function. Accordingly, Mn is added in order to improve the cleanliness of matrix and reduce low-melting point compounds. On the other hand, if the amount of Mn exceeds 1%, the oxidation resistance is reduced. Accordingly, the upper limit of the amount of Mn is set to 1%.

Ni: 40% to 50%

Ni maintains elongation at high temperatures, and is added as a component alternative to Co. By adding Cr, W, and selectively Ti and Zr, ire combination with Ni, high temperature strength in terms of oxidation resistance, compressive deformation resistance rate, and the like can be increased. Accordingly, Ni is added in an amount of 40% or more. On the other hand, if the amount of Ni exceeds 50%, the amount of other additional elements is reduced. In particular, a reduction in the amount of Cr leads to degradation various high-temperature properties. Furthermore, Ni is a rare metal and expensive, and thus if Ni is contained in an amount exceeding 50%, the product cost also increases. Accordingly the upper limit of the amount of Ni is set to 50%. Also, Ni is less expensive than Co, and thus by using Ni as a component alternative to Co, it is possible to provide hearth metal members at a low cost.

Cr: 25% to 35%

Cr is an element that is very effective in improving oxidation resistance due to the effect of addition in combination with Ni. In order to have the effect of addition in combination with Ni, Cr is added in an amount of 25% to 35%.

W: 1.0% to 3.0%

W is added to improve high-temperature strength, and at the same time, the effect of addition in combination with Ni contributes to improving oxidation resistance. It is desirable that the amount of W is small because W is an expensive element. However, in order to obtain the above effect, W is added in an amount of 1.0% to 3.0%.

The remainder is 10% or more of Fe and inevitable impurities as the balance. The following elements may be added selectively.

Ti: 0.05% to 0.5% and/or Zr: 0.02% to 1.0%

Ti and Zr are added alone or in combination to improve oxidation resistance and increase high-temperature compression creep strength. Zr also has a denitrification effect. In order to obtain the effects described above, the amount of Ti is set to 0.05% or more, and the amount of Zr is set to 0.02% or more. On the other hand, Ti may cause degradation of castability due to a reduction in the flowability of the alloy, and it may be difficult to machine the alloy. Accordingly, the upper limit of the amount of Ti is set to 0.5%. Zr causes a reduction in hot plastic workability (for example, bending), and thus the upper limit of the amount of Zr is set to 1.0%.

Examples of inevitable impurities that are elements unavoidably contained in the heat-resistant alloy in an ordinary melting technique include P, S, N, O, and H. These elements may be contained in the following amounts: 0.03% or less of P, 0.03% or less of S, 0.2% or less of N, 0.2% or less of O, and 0.1% or less of H.

DESCRIPTION OF EMBODIMENTS

The heat-resistant alloy for a hearth metal member according to the present invention can be produced by casting the component elements described above and performing heat treatment and machining so as to shape the alloy into a desired shape. The hearth metal member may be, for example, a skid button or a skid rail, Here, the hearth metal member may be completely made of the heat-resistant alloy of the present invention, or may be partially made of the heat-resistant alloy of the present invention depending on the hearth structure, the furnace operation conditions, or the like. For example, only a portion that comes into contact with the slab may be formed using the heat-resistant alloy of the present invention.

As will be shown in examples below, the heat-resistant alloy for a hearth metal member according to the present invention has a solidus temperature of about 1300° C. to 1400° C. Accordingly, the heat-resistant alloy of the present invention is preferably used in the preheating zone and the heating zone of a heating furnace, and it is more desirable that the heat-resistant alloy of the present invention is used in the heating zone operating at about 1100° C. to 1300° C.

The heat-resistant alloy for a hearth metal member according to the present invention is free of Co, and thus will not be regulated under the Japanese Industrial Safety and Health Act. Also, as will be shown in examples given below, the heat-resistant alloy of the present invention has a high solidus temperature and high high-temperature strength in terms of oxidation resistance, compressive deformation resistance rate, and the like. Accordingly, it is very useful as an alternative to Co-containing heat resistant steel used in hearth metal members.

EXAMPLES

Heat-resistant alloys having compositions shown in Table 1 were used to produce molten metals through atmospheric melting in a high-frequency induction melting furnace, and the molten metals were subjected to casting to obtain samples. In the samples shown in Table 1, Inventive Examples 1 to 5 are examples according to the present invention, and Comparative Examples 1 to 7 are comparative examples. Also, for comparison, a sample containing Co was produced as Reference Example.

TABLE 1

| | C | Si | C + Si | Mn | P | S | Ni | Cr | W | Mo | Co | Ti | Zr | N | O | Fe (remainder) |
|---|---|---|---|---|---|---|---|---|---|---|---|---|---|---|---|---|
| Inventive Example 1 | 0.2 | 0.5 | 0.7 | 0.6 | 0.005 | 0.003 | 46.0 | 33.0 | 2.0 | | | 0.1 | 0.1 | | | 17.5 |
| Inventive Example 2 | 0.2 | 0.3 | 0.5 | 0.3 | 0.001 | 0.004 | 45.0 | 33.0 | 2.0 | | | | | 0.001 | 0.050 | 19.2 |
| Inventive Example 3 | 0.2 | 0.3 | 0.5 | 0.4 | 0.007 | 0.006 | 45.0 | 33.0 | 2.0 | | | 0.05 | | 0.001 | 0.044 | 19.0 |
| Inventive Example 4 | 0.2 | 0.3 | 0.5 | 0.5 | 0.001 | 0.005 | 46.0 | 33.0 | 2.0 | | | | 0.1 | 0.001 | 0.061 | 17.9 |
| Inventive Example 5 | 0.2 | 0.3 | 0.5 | 0.5 | 0.001 | 0.005 | 45.0 | 33.0 | 2.0 | | | 0.1 | 0.1 | 0.001 | 0.050 | 18.8 |
| Comp. Ex. 1 | 0.1 | 0.8 | 0.9 | 0.7 | 0.007 | 0.001 | 44.3 | 20.1 | 2.0 | | | | | | | 32.1 |
| Comp. Ex. 2 | 0.1 | 1.5 | 1.6 | 2.0 | 0.012 | 0.003 | 44.3 | 34.1 | 2.0 | | | | | | | 16.1 |
| Comp. Ex. 3 | 0.1 | 1.1 | 1.2 | 0.7 | | | 30.0 | 44.8 | 2.9 | | | | | | | 20.4 |

TABLE 1-continued

| | C | Si | C + Si | Mn | P | S | Ni | Cr | W | Mo | Co | Ti | Zr | N | O | Fe (remainder) |
|---|---|---|---|---|---|---|---|---|---|---|---|---|---|---|---|---|
| Comp. Ex. 4 | 0.1 | 1.1 | 1.2 | 2.1 | | | 19.7 | 45.0 | 2.9 | | | | | | | 29.1 |
| Comp. Ex. 5 | 0.4 | 0.7 | 1.1 | 0.6 | 0.005 | 0.003 | 45.0 | 32.5 | 2.0 | | | 0.1 | 0.0 | | | 18.7 |
| Comp. Ex. 6 | 0.4 | 0.6 | 1.0 | 0.6 | 0.013 | 0.003 | 46.2 | 30.3 | 3.6 | | | 0.1 | 0.0 | | | 18.2 |
| Comp. Ex. 7 | 0.4 | 0.5 | 1.3 | 0.5 | 0.009 | 0.007 | 42.1 | 43.2 | 2.3 | | | 0.1 | 0.0 | | | 10.9 |
| Ref. Ex. | 0.1 | 1.3 | 1.4 | 1.2 | 0.011 | 0.014 | 16.4 | 26.5 | | 1.0 | 38.3 | | | | | 15.2 |

Then, the solidus temperature, the tensile strength, the tensile elongation, the compressive deformation ratio, and the oxidation reduction rate that is an indicator of oxidation resistance were measured for each sample, and an evaluation was made. The results are shown in Tables 2 to 5.

The solidus temperature is a value measured at a heating rate of 3° C./min. The results are shown in Table 2.

The tensile strength was measured at temperatures of 600° C., 800° C., 900° C., and 1100° C. in accordance with JIS Z2241. The results are shown in Table 2 as actually measured values.

The tensile elongation was measured at temperatures of 600° C., 800° C., 900° C., and 1100° C. in accordance with JIS 22241, and the ratio of the length of each sample at break relative to the original length of the sample was calculated as a percentage (%). The results are shown in Table 3 as actually measured values.

The compressive deformation ratio was measured using a plurality of cylindrical test pieces (each having a height of 50 mm and a diameter of 30 mm) obtained by cutting each sample. More specifically, in an electric furnace at an internal temperature of 1300° C., the test pieces were fixed upright on a fixing table, and a compressive load of 9.81 $N/mm^2$ was repeatedly applied to the test pieces while maintaining the temperature of the test pieces at 1230° C. to 1260° C. The repetitive application of a load was performed as follows. The operation (a total of 12 seconds) of applying the load for 5 seconds and applying no load for 5 seconds, with each transition time between the application of the load and the application of no load being set to 1 second, was defined as one cycle, and the cycle was repeatedly performed on each test piece 2000 times. This test was performed on two to four test pieces, and then the ratio of change in height and the ratio of change in diameter of each test piece were measured before and after the test, and the average of each ratio of change (%) was calculated. The results are shown in Table 4 as actually measured values.

The oxidation reduction rate was also measured using round-rod shaped test pieces (each having a length of 50 mm and a diameter of 10 mm) obtained by cutting each sample. More specifically, each test piece was kept in an atmosphere at temperatures of 1200° C., 1252° C., and 1302° C. for 100 hours, and then a weight change of the test piece due to oxidation was measured to obtain the oxidation reduction rate (mm/year). The results are shown in Table 5 as actually measured values.

The results of the above-described tests are shown in Tables 2 to 5. A blank space in the tables indicates that measurement was not performed on the sample.

The solidus temperature was measured using all samples. As shown in Table 2, it can be seen that all samples had a solidus temperature (actually measured value) above 1300° C. On the other hand, in a heating furnace, in order to achieve stable operation particularly in the heating zone and the soaking zone, the alloy is required to have a solidus temperature greater than 1300° C. by 50° C. to 60° C. or more. Accordingly, the following evaluation criteria for solidus temperature was used: a sample that had a solidus temperature of 1400° C. or higher, which was close to that of Reference Example, was rated as "A"; a sample that had a solidus temperature of 1380° C. or higher was rated as "B"; a sample that had a solidus temperature of 1360° C. or higher was rated as "C"; and a sample that had a solidus temperature less than 1360° C. was rated as "D". As a result, as shown in Table 2, none of the samples of Inventive Examples and Comparative Examples was rated as "A", but the samples of Inventive Examples were rated as either "B" or "C". In Comparative Examples, the sample of Comparative Example 1 was rated as "C", and the other samples were rated as "D".

TABLE 2

| | Solidus | | Tensile strength | | | | | |
|---|---|---|---|---|---|---|---|---|
| | | | | Total | Individual score | | | |
| | Rating | Temp. (° C.) (actually measured value) | Rating | score | 600° C. | 800° C. | 900° C. | 1100° C. |
| Inventive Example 1 | C | 1,363 | B | 1 | −1 | 1 | 0 | 1 |
| Inventive Example 2 | C | 1,374 | | | | | | |
| Inventive Example 3 | B | 1,381 | | | | | | |
| Inventive Example 4 | B | 1,383 | C | 0 | −1 | 0 | 0 | 1 |
| Inventive Example 5 | B | 1,382 | | | | | | |
| Comp. Ex. 1 | C | 1,377 | C | 0 | −1 | −1 | 1 | 1 |
| Comp. Ex. 2 | D | 1,334 | A | 3 | 1 | 1 | 1 | 0 |

TABLE 2-continued

| | | | | | | | | |
|---|---|---|---|---|---|---|---|---|
| Comp. Ex. 3 | D | 1,322 | A | 4 | 1 | 1 | 1 | 1 |
| Comp. Ex. 4 | D | 1,336 | B | 2 | −1 | 1 | 1 | 1 |
| Comp. Ex. 5 | D | 1,340 | B | 2 | −1 | 1 | 1 | 1 |
| Comp. Ex. 6 | D | 1,342 | C | 0 | −1 | | 0 | 1 |
| Comp. Ex. 7 | D | 1,348 | B | 1 | −1 | | 1 | 1 |
| Ref. Ex. | | 1,412 | | | | | | |

| | Tensile strength | | | | | | | |
|---|---|---|---|---|---|---|---|---|
| | Comparison with Reference Example | | | | Actually measured value (N/mm$^3$) | | | |
| | 600° C. | 800° C. | 900° C. | 1100° C. | 600° C. | 800° C. | 900° C. | 1100° C. |
| Inventive Example 1 | −7% | 8% | 2% | 19% | 330 | 244 | 167 | 63 |
| Inventive Example 2 | | | | | | | | |
| Inventive Example 3 | | | | | | | | |
| Inventive Example 4 | −12% | 0% | −3% | 9% | 310 | 226 | 158 | 58 |
| Inventive Example 5 | | | | | | | | |
| Comp. Ex. 1 | −26% | −14% | 16% | 8% | 261 | 194 | 189 | 57 |
| Comp. Ex. 2 | 12% | 31% | 26% | 4% | 394 | 296 | 206 | 55 |
| Comp. Ex. 3 | 11% | 41% | 34% | 9% | 392 | 318 | 218 | 58 |
| Comp. Ex. 4 | −24% | 10% | 10% | 9% | 267 | 249 | 179 | 58 |
| Comp. Ex. 5 | −8% | 22% | 18% | 45% | 326 | 275 | 193 | 77 |
| Comp. Ex. 6 | −27% | | 2% | 8% | 256 | | 166 | 57 |
| Comp. Ex. 7 | −19% | | 20% | 9% | 286 | | 196 | 58 |
| Ref. Ex. | | | | | 353 | 226 | 163 | 53 |

The tensile strength was measured using all samples excluding those of Inventive Examples 2, 3, and 5. Also, for the samples of Inventive Example 2, and Comparative Examples 6 and 7, the tensile strength was measured only at some measurement temperatures. Each measured value of tensile strength (actually measured values) was scored relative to the actually measured value of Reference Example obtained at each measurement temperature based on the following scale: "−1" was given when the difference was less than −5%, "0" was given when the difference was within ±5%, and "+1" was given when the difference was greater than +5%. The individual scores at each measurement temperature are shown in Table 2. Then, a rating of "A" was given when the total score was +3 or greater and there was no minus value. A rating of "B" was given when the total score was greater than 0. A rating of "C" was given when the total score was 0. A rating of "D" was given when the total score was less than 0. The results are collectively shown in Table 2.

As shown in Table 2, in terms of tensile strength, the samples of Comparative Examples 2 and 3 were rated as "A", the samples of Inventive Example 1 and Comparative Examples 4, 5, and 7 were rated as "B", and the other samples were rated as either "C" or "D".

The tensile elongation was measured using all samples excluding those of Inventive Example 3. For the samples of Inventive Examples 2 and 5 and Comparative Examples 6 and 7, the tensile elongation was measured only at some measurement temperatures. Each measured value of tensile elongation (actually measured values) was scored relative to the actually measured value (14%) of Reference Example obtained at 600° C. based on the following scale: "−1" was given when the actually measured value was less than 14%, and "+1" was given when the actually measured value was 14% or more. Generally, the tensile strength increases as the temperature increases. Accordingly, at measurement temperatures of 800° C. or higher, evaluation was performed relative to the same value (14%). The individual scores at each measurement temperature are shown in Table 3, Then, a rating of "B" was given when the total score was greater than 0 and there was no minus value, and a rating of "C" was given when the total score was less than 0 or there was a minus value. The results are collectively shown in Table 3.

TABLE 3

| | Tensile elongation | | | | | | | | | |
|---|---|---|---|---|---|---|---|---|---|---|
| | | | Individual score | | | | Actually measured value (%) | | | |
| | Rating | Total score | 600° C. | 800° C. | 900° C. | 1100° C. | 600° C. | 800° C. | 900° C. | 1100° C. |
| Inventive Example 1 | B | 4 | 1 | 1 | 1 | 1 | 27.7 | 21.3 | 22.8 | 20.6 |
| Inventive Example 2 | B | 3 | 1 | | 1 | 1 | 25.9 | | 23.5 | 21.2 |
| Inventive Example 3 | | | | | | | | | | |
| Inventive Example 4 | B | 4 | 1 | 1 | 1 | 1 | 26.3 | 19.8 | 26.6 | 24.5 |

TABLE 3-continued

| | Tensile elongation | | | | | | | | | |
|---|---|---|---|---|---|---|---|---|---|---|
| | | | Individual score | | | | Actually measured value (%) | | | |
| | Rating | Total score | 600° C. | 800° C. | 900° C. | 1100° C. | 600° C. | 800° C. | 900° C. | 1100° C. |
| Inventive Example 5 | B | 1 | | | 1 | | | | 24.2 | |
| Comp. Ex. 1 | B | 4 | 1 | 1 | 1 | 1 | 34.5 | 22.1 | 26.4 | 31.8 |
| Comp. Ex. 2 | C | 0 | −1 | −1 | 1 | 1 | 2.4 | 7.9 | 15.4 | 40.6 |
| Comp. Ex. 3 | C | 0 | −1 | −1 | 1 | 1 | 1.9 | 4.7 | 15.9 | 42.1 |
| Comp. Ex. 4 | B | 4 | 1 | 1 | 1 | 1 | 39.4 | 18.7 | 29.3 | 22.7 |
| Comp. Ex. 5 | C | 2 | −1 | 1 | 1 | 1 | 9.3 | 17.7 | 18.4 | 19.2 |
| Comp. Ex. 6 | C | 2 | 1 | −1 | 1 | 1 | 14.6 | | 18.4 | 19.2 |
| Comp. Ex. 7 | C | −2 | −1 | −1 | −1 | 1 | 3.2 | | 13.4 | 18.8 |
| Ref. Ex. | | | | | | | 14.0 | 21.3 | 11.6 | 25.3 |

As shown in Table 3, in terms of tensile elongation, the samples of Inventive Examples 1, 2, 4 and 5 and Comparative Examples 1 and 4 were rated as "B", and the other samples were rated as "C".

The compressive deformation ratio was measured using all samples. Each measured value of the compressive deformation ratio (actually measured values) was scored relative to the compressive deformation ratio (actually measured value) in the height or diameter direction of Reference Example based on the following scale: "+2" was given when the difference was less than −50%, "+1" was given when the difference was less than −5%, "0" was given when the difference was within ±5%, and "−1" was given when the difference was greater than +5%. The individual scores in the height and diameter directions are shown in Table 4, Then, a rating of "A" was given when the total score was +3 or greater and there was no minus value. A rating of "B" was given when the total score was greater than 0. A rating of "C" was given when the total score was 0. A rating of "D" was given when the total score was less than 0. The results are collectively shown in Table 4.

As shown in Table 4, in terms of compressive deformation ratio, the samples of Inventive Examples 1 to 5 and Comparative Examples 1 and 5 were rated as "A", the samples of Comparative Examples 4, 6 and 7 were rated as "B", and other samples were rated as "D".

The oxidation reduction rate was measured using all samples. However, for the samples of Inventive Examples 2 to 5, measurement was performed only at some measurement temperatures. Each measured value of the oxidation reduction rate (actually measured value) was scored relative to the actually measured value of Reference Example obtained at each measurement temperature based on the following scale: "+2" was given when the difference was less than −50%, "+1" was given when the difference was less than −5%, "0" was given when the difference was within ±5%, and "−1" was given when the difference was greater than +5%. The individual scores at each measurement temperature are shown in Table 5, Then, a rating of "B" was given when the total score was greater than 0. A rating of "C" was given when the total score was 0. A rating of "D" was given when the total score was less than 0 and there were two or more minus values. The results are collectively shown in Table 5.

TABLE 4

| | Compressive deformation ratio | | | | | | | |
|---|---|---|---|---|---|---|---|---|
| | | | Individual score | | Comparison with Reference Example | | Actually measured value (%) | |
| | Rating | Total score | Height | Diameter | Height | Diameter | Height | Diameter |
| Inventive Example 1 | A | 4 | 2 | 2 | −87% | −70% | 0.6 | 3.4 |
| Inventive Example 2 | A | 4 | 2 | 2 | −66% | −63% | 1.6 | 4.2 |
| Inventive Example 3 | A | 4 | 2 | 2 | −82% | −60% | 0.9 | 4.6 |
| Inventive Example 4 | A | 4 | 2 | 2 | −73% | −71% | 1.3 | 3.3 |
| Inventive Example 5 | A | 4 | 2 | 2 | −84% | −77% | 0.8 | 2.7 |
| Comp. Ex. 1 | A | 4 | 2 | 2 | −83% | −75% | 0.8 | 2.9 |
| Comp. Ex. 2 | D | −2 | −1 | −1 | 259% | 165% | 16.5 | 30.0 |
| Comp. Ex. 3 | D | −2 | −1 | −1 | 188% | 117% | 13.3 | 24.6 |
| Comp. Ex. 4 | B | 2 | 1 | 1 | −45% | −38% | 2.5 | 7.0 |
| Comp. Ex. 5 | A | 4 | 2 | 2 | −92% | −88% | 0.4 | 1.3 |
| Comp. Ex. 6 | B | 3 | 2 | 1 | −72% | −48% | 1.3 | 5.9 |
| Comp. Ex. 7 | B | 3 | 2 | 1 | −72% | −48% | 1.3 | 5.9 |
| Ref. Ex. | | | | | | | 4.6 | 11.3 |

TABLE 5

| | Oxidation reduction rate | | | | | | | | | | |
|---|---|---|---|---|---|---|---|---|---|---|---|
| | | Total | Individual score | | | Comparison with Reference Example | | | Actually measured value (mm/year) | | |
| | Rating | score | 1200° C. | 1252° C. | 1302° C. | 1200° C. | 1252° C. | 1302° C. | 1200° C. | 1252° C. | 1302° C. |
| Inventive Example 1 | B | 2 | −1 | 1 | 2 | 50% | −35% | −79% | 0.83 | 2.17 | 2.69 |
| Inventive Example 2 | B | 1 | −1 | | 2 | 130% | | −86% | 1.28 | | 1.87 |
| Inventive Example 3 | B | 1 | −1 | | 2 | 186% | | −75% | 1.59 | | 3.22 |
| Inventive Example 4 | B | 1 | −1 | | 2 | 213% | | −77% | 1.74 | | 2.92 |
| Inventive Example 5 | B | 1 | −1 | | 2 | 271% | | −71% | 2.06 | | 3.72 |
| Comp. Ex. 1 | D | −3 | −1 | −1 | −1 | 221% | 2002% | 1136% | 1.79 | 69.54 | 160.34 |
| Comp. Ex. 2 | B | 2 | −1 | 1 | 2 | 154% | −14% | −68% | 1.41 | 2.86 | 4.18 |
| Comp. Ex. 3 | C | 0 | −1 | −1 | 2 | 278% | 15% | −58% | 2.10 | 3.82 | 5.44 |
| Comp. Ex. 4 | B | 3 | 0 | 1 | 2 | 4% | −35% | −76% | 0.58 | 2.16 | 3.10 |
| Comp. Ex. 5 | B | 2 | −1 | 1 | 2 | 105% | −28% | −65% | 1.14 | 2.38 | 4.52 |
| Comp. Ex. 6 | D | −3 | −1 | −1 | −1 | 314% | 55% | 27% | 2.30 | 5.14 | 16.50 |
| Comp. Ex. 7 | B | 2 | −1 | 1 | 2 | 120% | −3% | −63% | 1.22 | 3.21 | 4.80 |
| Ref. Ex. | | | | | | | | | 0.56 | 3.31 | 12.97 |

As shown in Table 5, the samples of Inventive Examples 1 to 5 and Comparative Examples 2, 4, 5 and 7 were rated as "B", and other samples were rated as "D".

Then, the ratings "A" to "D" of each sample obtained above were again scored as follows: "+2" was given to a rating of "A", "+1" was given to a rating of "B", "0" was given to a rating of "C", and "−1" was given to a rating of "D". The ratings and scores (within parentheses) of each sample are shown in Table 6. Then, the overall rating of each sample was determined based on the scores. In the overall rating, a rating of "A" was given when the total score was greater than 3 and there was no minus value, a rating of "B" was given when the total score was 3, a rating of "C" was given when the total score was 0 to 2, and a rating of "D" was given when the total score was less than 0 or there were two or more minus values. The overall ratings are shown in Table 6.

As shown in Table 6, all of the samples of Inventive Examples were rated as "A" in the overall rating, from which it can be seen that they have properties superior to or equal to those of the Co-containing heat resistant steel of Reference Example. That is, it can be seen that the heat-resistant alloys of Inventive Examples are very useful as an alternative to Co-containing heat resistant steel used in hearth metal members.

On the other hand, all of the samples of Comparative Examples were rated as any one of "B" to "D" in the overall rating. The following factors are considered to be the cause thereof.

In Comparative Example 1, the amount of C, the amount of Si, and the total amount of C and Si (C+Si) were within the ranges of the present invention, and thus the solidus temperature was high. However, the amount of Cr was less than the range of the present invention, and thus sufficient oxidation resistance (oxidation reduction rate) was not obtained.

In Comparative Example 2, the amount of Si and the total amount of C and Si (C+Si) exceeded the ranges of the

TABLE 6

| | Solidus | Tensile strength | Tensile elongation | Compressive deformation ratio | Oxidation reduction rate | Overall rating |
|---|---|---|---|---|---|---|
| Inventive Example 1 | C (0) | B (1) | B (1) | A (2) | B (1) | A |
| Inventive Example 2 | C (0) | | B (1) | A (2) | B (1) | A |
| Inventive Example 3 | B (1) | | | A (2) | B (1) | A |
| Inventive Example 4 | B (1) | C (0) | B (1) | A (2) | B (1) | A |
| Inventive Example 5 | B (1) | | | A (2) | B (1) | A |
| Comp. Ex. 1 | C (0) | C (0) | B (1) | A (2) | D (−1) | C |
| Comp. Ex. 2 | D (−1) | A (2) | C (0) | D (−1) | B (1) | D |
| Comp. Ex. 3 | D (−1) | A (2) | C (0) | D (−1) | C (0) | D |
| Comp. Ex. 4 | D (−1) | B (1) | B (1) | B (1) | B (1) | B |
| Comp. Ex. 5 | D (−1) | B (1) | C (0) | A (2) | B (1) | B |
| Comp. Ex. 6 | D (−1) | C (0) | C (0) | B (1) | D (−1) | D |
| Comp. Ex. 7 | D (−1) | B (1) | C (0) | B (1) | B (1) | C |

present invention, and thus the solidus temperature was low. Accordingly in the oxidation resistance test, sufficient oxidation resistance was observed, but the alloy may melt or the oxidation amount may increase when the temperature rises due to an anomaly in the heating furnace.

In Comparative Examples 3 and 4, the amount of Si and the total amount of C and Si (C+Si) exceeded the ranges of the present invention, and the solidus temperature was low. Also, the amount of Cr exceeded the range of the present invention, and thus sufficient ductility (tensile elongation) was not obtained. Furthermore, in Comparative Example 4, the amount of Ni was less than the range of the present invention, and the tensile strength was low.

In Comparative Example 5, the amount of C, the amount of Ni, and the amount of Cr were within the ranges of the present invention, but the total amount of C and Si (C+Si) exceeded the range of the present invention, and thus the solidus temperature was low and the tensile elongation was low.

In Comparative Example 6, the amount of C, the amount of Si, and the total amount of C and Si (C+Si) were within the ranges of the present invention. However, the amount of W exceeded the range of the present invention, and thus the oxidation resistance was low.

In Comparative Example 7, the amount of C, the amount of Si, and the total amount of C and Si (C+Si) were within the ranges of the present invention. However, the amount of Cr exceeded the range of the present invention, sufficient ductility was not obtained.

The foregoing description is given merely to describe the present invention. Accordingly, it should not be construed as limiting the invention recited in the appended claims or narrowing the scope of the present invention. Also, the constituent elements of the present invention are not limited to those described in the examples given above, and it is of course possible to make various modifications within the technical scope defined in the appended claims.

The invention claimed is:

1. A heat-resistant alloy for a hearth metal member of a steel heating furnace, the heat-resistant alloy consisting of:

0.2% to 0.5% of C;

more than 0% and 0.95% or less of Si, where $0.20<C+Si\leq1.0\%$;

more than 0% and 1.0% or less of Mn;

40% to 50% of Ni;

25% to 35% of Cr;

1.0% to 2.0% of W;

0.05% to 0.5% of Ti;

optionally, 0.02% to 1.0% of Zr; and

10% or more of Fe and inevitable impurities as the balance, with all percentages being in mass %.

2. The heat-resistant alloy for a hearth metal member according to claim 1, wherein the inevitable impurities consist of at least one selected from the group consisting of 0.2% or less of N, 0.2% or less of 0, and 0.1% or less of H, with all percentages being in mass %.

3. A hearth metal member of a steel heating furnace, wherein the hearth metal member partially or entirely consists of the heat-resistant alloy for a hearth metal member according to claim 2.

4. A hearth metal member of a steel heating furnace, wherein the hearth metal member partially or entirely consists of the heat-resistant alloy for a hearth metal member according to claim 1.

5. The heat-resistant alloy for a hearth metal member according to claim 1, wherein the heating zone of the hearth metal member is from 1100° C. to 1300° C.

6. The heat-resistant alloy for a hearth metal member according to claim 1, wherein the inevitable impurities consist of 0.03% or less of P and/or 0.03% or less of S, with all percentages being in mass %.

7. A hearth metal member of a steel heating furnace, wherein the hearth metal member partially or entirely consists of the heat-resistant alloy for a hearth metal member according to claim 6.

8. The heat-resistant alloy for a hearth metal member according to claim 6, wherein the inevitable impurities consist of at least one selected from the group consisting of 0.2% or less of N, 0.2% or less of 0, and 0.1% or less of H, with all percentages being in mass %.

9. A hearth metal member of a steel heating furnace, wherein the hearth metal member partially or entirely consists of the heat-resistant alloy for a hearth metal member according to claim 8.

10. The heat-resistant alloy for a hearth metal member according to claim 1, wherein there is present 0.02% to 1.0% of Zr, with all percentages being in mass %.

11. A hearth metal member of a steel heating furnace, wherein the hearth metal member partially or entirely consists of the heat-resistant alloy for a hearth metal member according to claim 10.

12. The heat-resistant alloy for a hearth metal member according to claim 10, wherein the inevitable impurities consist of at least one selected from the group consisting of 0.2% or less of N, 0.2% or less of 0, and 0.1% or less of H, with all percentages being in mass %.

13. A hearth metal member of a steel heating furnace, wherein the hearth metal member partially or entirely consists of the heat-resistant alloy for a hearth metal member according to claim 12.

14. The heat-resistant alloy for a hearth metal member according to claim 10, wherein the inevitable impurities consist of 0.03% or less of P and/or 0.03% or less of S, with all percentages being in mass %.

15. A hearth metal member of a steel heating furnace, wherein the hearth metal member partially or entirely consists of the heat-resistant alloy for a hearth metal member according to claim 14.

16. The heat-resistant alloy for a hearth metal member according to claim 14, wherein the inevitable impurities consist of at least one selected from the group consisting of 0.2% or less of N, 0.2% or less of 0, and 0.1% or less of H, with all percentages being in mass %.

17. A hearth metal member of a steel heating furnace, wherein the hearth metal member partially or entirely consists of the heat-resistant alloy for a hearth metal member according to claim 16.

* * * * *